US007010877B2

(12) United States Patent
Geary

(10) Patent No.: US 7,010,877 B2
(45) Date of Patent: Mar. 14, 2006

(54) BEVERAGE LABEL ASSEMBLY

(76) Inventor: Roger W. Geary, 1214 N. Shoridan Rd., Lake Forest, IL (US) 60045

( * ) Notice: Subject to any disclaimer, the term of this patent is extended or adjusted under 35 U.S.C. 154(b) by 0 days.

(21) Appl. No.: 10/644,534

(22) Filed: Aug. 19, 2003

(65) Prior Publication Data

US 2005/0039357 A1 Feb. 24, 2005

(51) Int. Cl.
*G09F 3/00* (2006.01)

(52) U.S. Cl. ..... 40/310; 40/638; 283/81

(58) Field of Classification Search ..... 40/310, 40/306, 638; 283/81
See application file for complete search history.

(56) References Cited

U.S. PATENT DOCUMENTS

| | | | | | |
|---|---|---|---|---|---|
| 1,312,611 | A * | 8/1919 | Chess | 40/310 |
| 1,982,282 | A * | 11/1934 | Bock | 40/310 |
| 3,757,934 | A * | 9/1973 | Taub | 40/310 |
| 3,874,977 | A * | 4/1975 | Pyles | 40/310 |
| 4,115,939 | A | 9/1978 | Marks | 40/310 |
| 5,342,093 | A | 8/1994 | Weernink | 285/81 |
| 5,439,721 | A | 8/1995 | Pedroli et al. | 428/40 |
| 5,535,536 | A * | 7/1996 | Comann | 40/310 |
| 5,758,440 | A | 6/1998 | Yudin | 40/310 |
| 5,809,674 | A | 9/1998 | Key | 40/306 |
| 5,953,170 | A | 9/1999 | Glancy | 359/896 |
| 5,992,892 | A | 11/1999 | Schaefer et al. | 283/901 |
| 6,086,697 | A | 7/2000 | Key | 156/215 |
| 6,129,802 | A | 10/2000 | Key | 156/229 |
| 6,237,269 | B1 * | 5/2001 | Key | 40/310 |
| 6,272,777 | B1 | 8/2001 | Swenson | 40/310 |
| 6,454,094 | B1 | 9/2002 | Salani | 206/459.1 |
| 6,581,972 | B1 | 6/2003 | Nojima et al. | 283/81 |
| 2002/0050715 | A1 * | 5/2002 | Elpidi | 283/81 |

* cited by examiner

*Primary Examiner*—Gary C. Hoge
(74) *Attorney, Agent, or Firm*—Law Office of Marc D. Machtinger, Ltd.

(57) ABSTRACT

A label assembly having multiple viewing areas and indicia portions is disclosed. A label is affixed to a non-opaque container, such as a glass or plastic bottle. The container contains an opaque substance, such as a consumable beverage. In one embodiment, the label includes two vertically separated viewing areas through which indicia portions on the inward side of the label on the opposite side of the bottle can be viewed. Thus, as the beverage is consumed below a first level, the first indicia portion becomes viewable through the first viewing area. As the beverage is consumed below a second level, the second indicia portion becomes viewable through the second viewing area. The first indicia portion is optionally an inquiry or question, and the second indicia portion is optionally a response or answer which is logically related to the first indicia portion. Packages of such containers can be assembled having various configurations of categories of subject matter contained in the indicia portion pairs.

41 Claims, 4 Drawing Sheets

BEVERAGE LABEL ASSEMBLY

TECHNICAL FIELD

The present invention relates to a label assembly, and more particularly, to a label assembly having viewing areas through which indicia on the opposite inward side of a label can be viewed.

BACKGROUND OF THE INVENTION

Two sided label printing is known in the bottling industry. For example, U.S. Pat. No. 6,581,972 to Nojima, et al. discloses a tubular label, elongated tubular member and method of manufacturing the same, as well as container having such a tubular label. Nojima, et al. provides a tubular label with pre-printed fixed information adapted to be wrapped around a container body of a container with an inwardly facing surface of the tubular label contacting the container body and the pre-printed fixed information being visible from the outside of the container. The tubular label includes printed arbitrary information such as lottery indicia provided on the inwardly facing surface by a non-impact printer in such a manner as to be invisible through the outwardly facing surface of the tubular label. In one embodiment, a transparent window portion is provided on the opposite side of the tubular label, through which the arbitrary information can be visually observed. The tubular label is designed to be used as a lottery or campaign application ticket that is capable of preventing mischievous conduct at the store, or any other places, and providing purchasers with an easy way to confirm given information such as winning or losing symbols.

U.S. Pat. No. 5,953,170 to Glancy provides a label for a container which has a secure manner of concealing an image, such as a game prize, which cannot be read or tampered with without revealing an intrusion or violation of the container. Glancy discloses a label for a container which is at least partially translucent, an image bearing portion located on part of the label with the image bearing portion including an image which is in a visually incoherent form, and a viewing member located on another part of the label for rendering the image in a visually coherent form when the image is viewed through the viewing member. The image or message provided on the image bearing portion can be optically encoded so as not to be intelligible except when viewed through the viewing member, such as a decoding window. Encoding/decoding techniques which can be utilized include, but are not limited to, lenticular indicia and hologram indicia, both of which are decoded by using techniques "matched" to the encoding technique. The label may be integrally formed on, for example, a box-type container.

Another example is U.S. Pat. No. 4,115,939 to Marks, which discloses a bottle with a multiple part label. In Marks, a package construction is provided in which a glass bottle containing a light-permeable liquid has front and rear label sections thereon to be viewed in cooperative relationship, such as cooperating to form a single image. The rearmost label has information thereon which is printed in distorted form in order to compensate for the optical distortion of the same due to refraction of the bottle and liquid therein. The front label section may be provided with a distorted opening through which the rear label section is viewed.

Lastly, U.S. Pat. No. 6,272,777 to Swenson discloses a packaging system for clear bottled liquids. In Swenson, the packaging system for bottled liquids includes a transparent bottle filled with clear liquid allowing a first surface to be viewable through an opposite second arcuate surface. A first label having indicia on a first side is attached to the first surface such that the indicia are substantially magnified when viewed through the second arcuate surface of the bottle. In effect, the packaging system is designed to utilize the curvature of the bottle to magnify indicia on the inwardly facing side of the label adhered to the bottle.

None of the conventional label assemblies provide for multiple viewing areas on a label, nor multiple indicia portions on the inward facing label which relate to one another, nor viewing areas which require consumption of a beverage to multiple respective levels in order to view respective indicia portions.

Therefore, it would be advantageous to provide a label assembly which provides for multiple viewing areas and indicia portions with various optional features and advantages.

SUMMARY

In view of the deficiencies described above, it is an object of the present invention to provide a label assembly having multiple viewing areas and indicia portions with various features and advantages.

The present invention is a label assembly for a container. The container is any suitable container formed of non-opaque material, such as glass or plastic. In various preferred embodiments, the container is a bottle for a consumable beverage. The label assembly is most suitable for a non-opaque bottle containing a substantially opaque liquid beverage.

The label is optionally formed as a single wrap-around label, or a two piece label having a separated front and back section. The label includes two windows, or viewing areas, through which the user can see indicia portions which are disposed on the opposite side of the label on its inward facing surface. The viewing areas are oriented in any of various configurations. In various preferred embodiments, the viewing areas are configured such that one is disposed vertically above the other. In this configuration, the user would need to consume the contents of the container below the level of the first viewing area in order to view the first indicia portion, and further below the level of the second viewing area in order to view the second indicia portion.

In certain preferred embodiments of the invention, the first and second indicia portions are logically related to one another. For example, the first indicia portion may contain an inquiry such as a question. The user would drink an opaque beverage, such as a beer or soft drink down below the level of the first viewing area and first indicia portion and read the question. Then, the beverage could be consumed down to a level below the second viewing area and second indicia portion, at which point the user could view the answer to the question.

Inquiry and response pairs can be categorized into distinct classes of subject matter, such as sports, entertainment, science, trivia, etc. Thus, packages of beverage bottles can be assembled with themes, the entire package containing a single category of subject matter, or alternatively, the package containing bottles each having a different category of subject matter.

Labels according to the present invention can be printed via double-sided printing. Preferably, the printing is of a non-impacting type which will prevent the indicia portions on the inward surface of the label from being viewable from the outward surface of the label. The viewing areas are formed as see-through sections of the label. Thus, the viewing areas may be formed via a hole stamped through the label, such as via die cutting. Alternatively, the viewing area may be a section of the label which is non-opaque. For example, the label could be formed of a non-opaque film and an opaque layer, and the viewing areas could be formed by stamping a hole through the opaque layer only. No decoding or visual distortions would be required in order to view the indicia portions, however, the inclusion of such devices would be within the scope of the present invention.

Other features and advantages of the invention will be apparent from the following detailed description taken in conjunction with the following drawings.

DETAILED DESCRIPTION

Figure 1A:
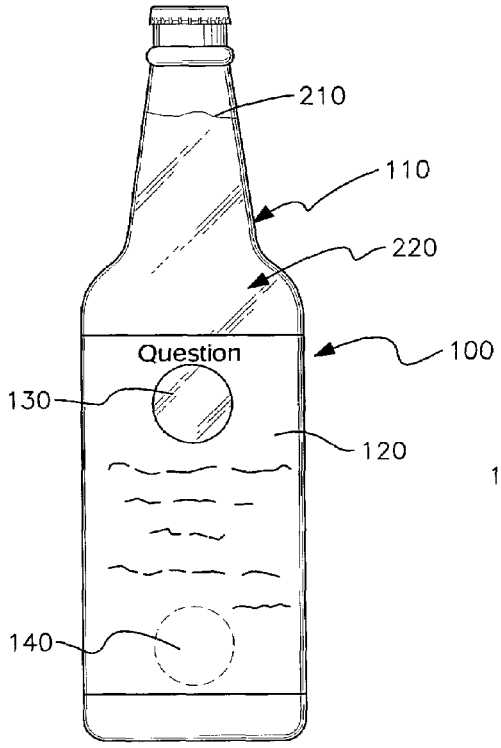
FIG. 1A is a front view of one embodiment of the present invention, showing a label assembly with the opaque beverage blocking view of the upper viewing area.
Figure 1B:
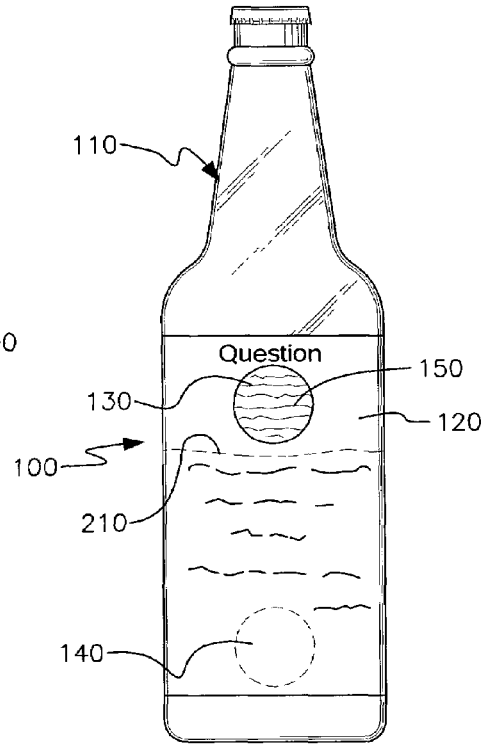
FIG. 1B is a front view of one embodiment of the present invention, showing a label assembly with the opaque beverage level being below the upper viewing area such that indicia can be viewed through the upper viewing area.
Figure 2A:
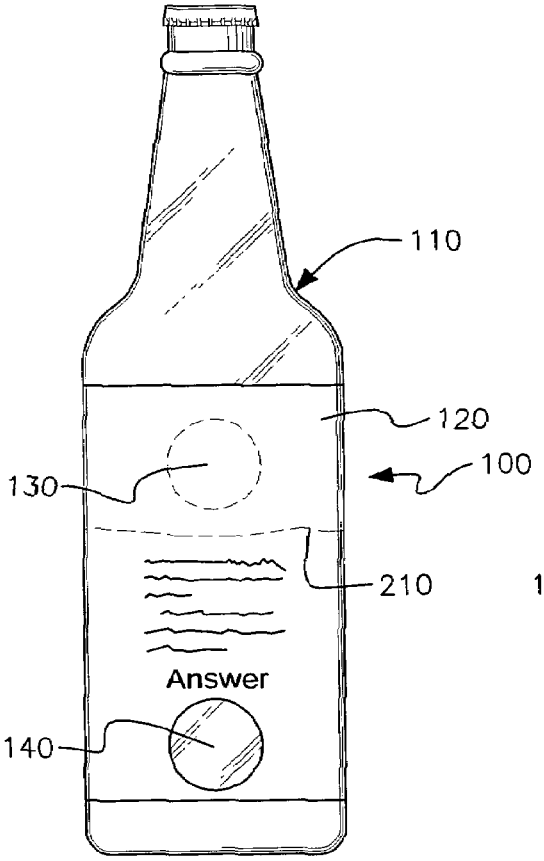
FIG. 2A is a rear view of one embodiment of the present invention, showing a label assembly with the opaque beverage blocking view of the lower viewing area.
Figure 2B:
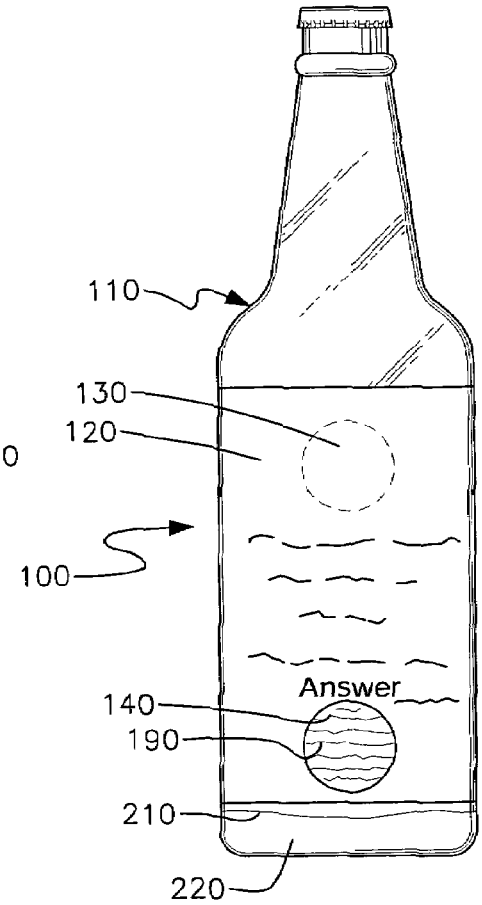
FIG. 2B is a rear view of one embodiment of the present invention, showing a label assembly with the opaque beverage level being below the lower viewing area such that indicia can be viewed through the lower viewing area.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is a label assembly 100 for a container 110. Container 110 can be any suitable non-opaque container, such as a bottle 110, jar, etc. By non-opaque, it is understood that the container 110 has properties which allows an individual to see through it. Thus, it may have a tint or other visual impedance, however, it would still be non-opaque. The container 110 can be formed of glass, plastic, or any other suitable non-opaque material.

The label assembly 100 comprises a label 120 affixed to the non-opaque container or bottle 110. The label 120 comprises a first viewing area 130 comprising an area free of opaque label material, and a second viewing area 140 comprising an area free of opaque label material. The viewing areas 130 and 140 are formed in several possible configurations. They may be formed as holes in the label 120. Alternatively, they may be formed as a portion of the label which has non-opaque label material only, such as a clear film layer. In either configuration, viewing areas 130 and 140 may be formed via die cutting or any other suitable means. The viewing areas 130 and 140 further may be formed with opaque label material substantially surrounding the viewing areas 130 and 140, or they may be areas which are open to the perimeter of the label 120.

Additionally, the label 120 comprises a first indicia portion 150 applied to an inward facing side 160 of the label 120 disposed substantially diametrically opposed from the first viewing area 130 about the bottle 110 and viewably aligned with the first viewing area 130. Thus, the first indicia portion 150 is not viewable from an outward facing side 170 of the label 120 in a first indicia area 180 of the label 120 on which it is applied. In other words, the indicia portions 150 and 190 are not seen through the label 120 in the vicinity of the indicia portions 150 and 190, despite the fact that they may be viewable from the opposite side of bottle 110 through a viewing area 130 or 140.

A second indicia portion 190 is applied to the inward facing side 160 of the label 120 and disposed substantially diametrically opposed from the second viewing area 140 about the bottle 120 and viewably aligned with the second viewing area 140. As above, the second indicia portion 190 is not viewable from the outward facing side 170 of the label 120 in a second indicia area 200 in its vicinity of the label 120 on which it is applied. Thus, the first indicia portion 150 is viewable through the first viewing area 130 when a level 210 of substantially opaque fluid 220 within the bottle 110 is below the first indicia portion 150 and the first viewing area 130. Furthermore, the second indicia portion 190 is viewable through the second viewing area 140 when the level 210 of substantially opaque fluid 220 within the bottle 110 is below the second indicia portion 190 and the second viewing area 140.

In various preferred embodiments, the first viewing area 130 is positioned vertically higher with respect to the bottle 110 than the second viewing area 140. Likewise, the first indicia portion 150 is positioned vertically above the second indicia portion 190. Note that being "vertically above" does not imply that one item is necessarily directly above the other, but rather that they are displaced in a vertical dimension, and thus might be positioned rotationally apart from one another about the bottle 110. Thus, three conditions are possible, as follows. Under the first condition, neither of the indicia portions 150 and 190 are viewable when the level 210 of substantially opaque fluid 220 within the bottle 110 is above the first indicia portion 150. Under the second condition, the first indicia portion 150 is viewable through the first viewing area 130 and the second indicia portion 190 is not viewable through the second viewing area 140 when the level 210 of substantially opaque fluid 220 within the bottle 110 is below the first indicia portion 150 and the first viewing area 130 but above the second indicia portion 190. Finally, under a third condition, both of the indicia portions 150 and 190 are viewable when the level 210 of substantially opaque fluid 220 within the bottle 110 is below the second indicia portion 190 and the second viewing area 140. In practice, the user would need to consume the beverage 220 down to a first level 210 in order to view the first indicia portion 150, and then to a second lower level 210 in order to view the second indicia portion 190.

Figure 3A:
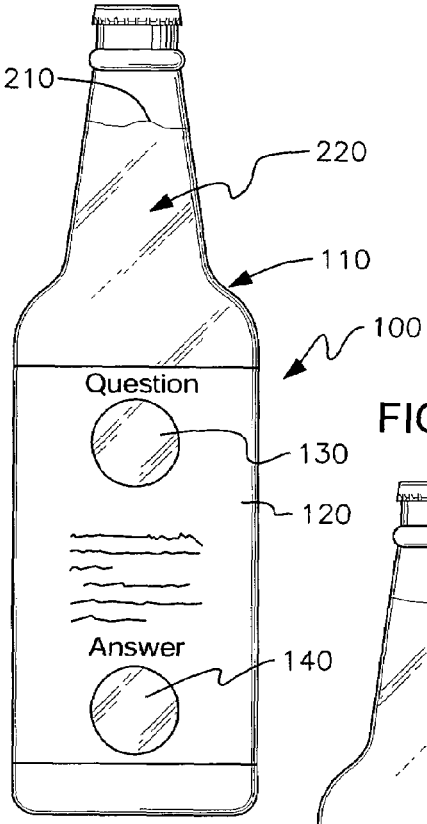
FIG. 3A is a front view of another embodiment of the present invention, showing a label assembly having at least two viewing areas on the same side, with the opaque beverage blocking view of both viewing areas.
Figure 3B:
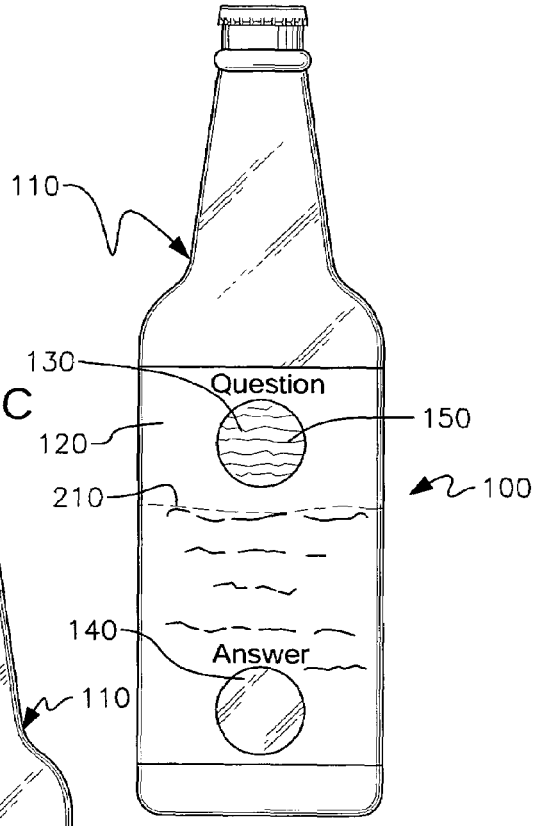
FIG. 3B is a front view of another embodiment of the present invention, showing a label assembly having at least two viewing areas on the same side, with the opaque beverage level being below the upper viewing area such that indicia can be viewed through the upper viewing area, yet blocking view of the lower viewing area.
Figure 3C:
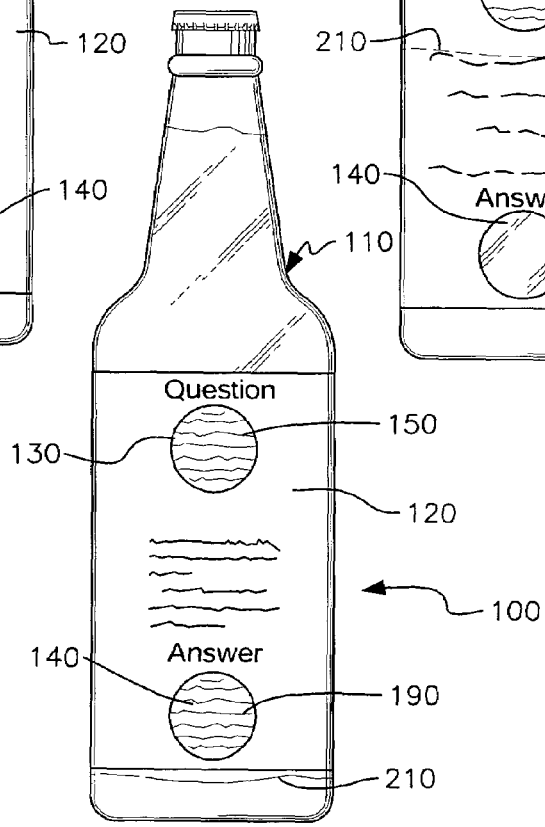
FIG. 3C is a front view of another embodiment of the present invention, showing a label assembly having at least two viewing areas on the same side, with the opaque beverage level being below both viewing areas, such that indicia can be viewed through both viewing areas.

In certain preferred embodiments, the first and second viewing areas 130 and 140 are disposed on the same side of the bottle 110, and substantially vertically aligned with one another, as shown in FIGS. 3A, 3B, and 3C. In other embodiments, the first and second viewing areas 130 and 140 are disposed on substantially opposite sides of the bottle, as illustrated in FIGS. 1A, 1B, 2A, and 2B.

Figure 5:
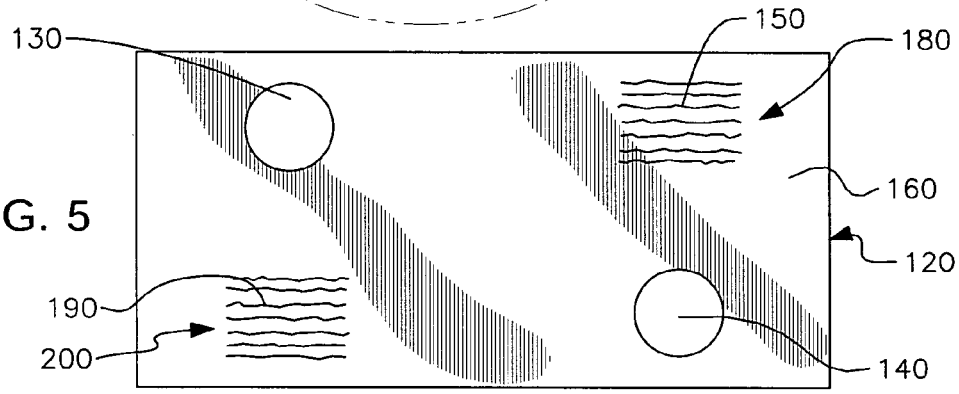
FIG. 5 is a rear view of a flattened label of one embodiment of the present invention.

The label 120 of the present invention can be formed in any suitable configuration. In certain preferred embodiments, the label is a single-piece wrap-around label, as shown in FIG. 5. In such embodiments, the viewing areas 130 and 140 and the indicia portions 150 and 190 are formed on the single-piece label 120. This can be advantageous, as indicia portions 150 and 190 would be coupled without having to keep track of different label sections. Such a label can be formed such that the edges of the label just meet, overlap, or leave a gap therebetween.

Figure 4:
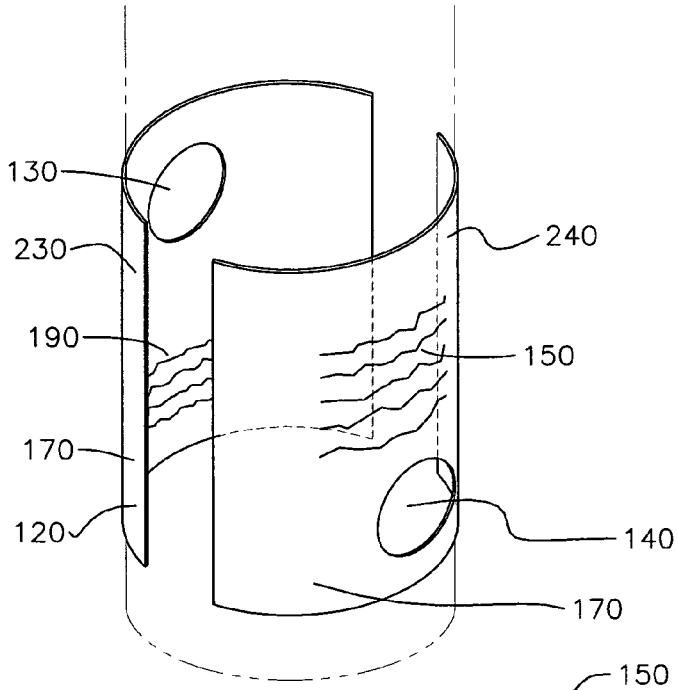
FIG. 4 is a perspective view of another embodiment of the present invention, showing configuration of an applied two-piece label.
Figure 6:
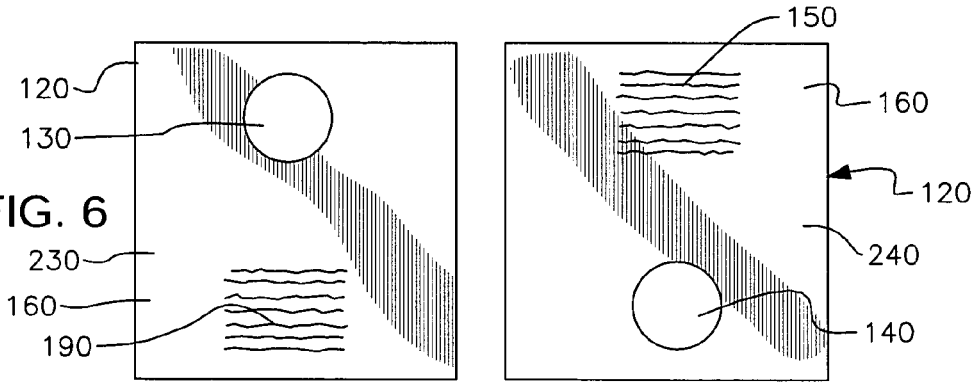
FIG. 6 is a rear view of a flattened two-piece label of another embodiment of the present invention.

In various other embodiments of the present invention, label 120 is formed of two separate sections, such as a front label section 230 and a back label section 240, as shown in FIGS. 4 and 6. These sections would be positioned to align the respective viewing areas 130 and 140 with the indicia portions 150 and 190. Thus, the first and second viewing areas 130 and 149 could be disposed on the front label section 230, and the first and second indicia portions 150 and 190 could be disposed on the back label section 240. Alternatively, the first viewing area 130 and the second indicia portion 190 could be disposed on the front label section 230, and the second viewing area 140 and the first indicia portion 150 could be disposed on the back label section 240.

The substance 220 contained in the container 110 could be any of various opaque items which would be emptied out of the container 110 at various levels. Thus, the substance 220 could be any liquid or solid. For example, it could be a beverage or consumable solid item such as a condiment. In certain preferred embodiments, the substance 220 is a dark beverage such as a beer, soft drink, or other opaque beverage.

In certain preferred embodiments, the first indicia portion 150 contains subject matter which is logically related to first outward side indicia disposed near the first viewing area 130, and the second indicia portion 190 contains subject matter which is logically related to second outward side indicia disposed near the second viewing area 140. Thus, a question could be contained on the outer portion of label 120, and answered via the indicia portions 150 and 190.

In various other embodiments of the invention, the second indicia portion 190 contains subject matter which is logically related to subject matter contained in said first indicia portion 150. Thus, the first indicia portion 150 may contain an inquiry, and the second indicia portion 190 may contain a response related to the inquiry. As used herein, it is understood that an inquiry may be any text or image which prompts the reader to formulate a thought related to the subject matter. Thus, the inquiry may be a question, a statement which answers another question, the beginning of a quote or statement, a photo or image, etc. Similarly, a response is understood to mean any text or image which is responsive to the inquiry, such as an answer, a question, a continuation of a statement or quote, a photo or image relating to a previous photo or image such as an image of a person in a different mode of attire or pose than an inquiry image, etc. The outer label 120 optionally clarifies the nature of the relationship between indicia portions 150 and 190, such as by indicating "Question" and "Answer."

In various embodiments, the present invention includes a beverage bottle package containing a plurality of bottles 110 each comprising the label assembly described above. The subject matter contained in the inquiry of each assembly is optionally classified in a distinct category, and each of the plurality of bottles 110 may either have inquiries classified in the same or different categories. Thus, variety packs or theme packs could be assembled for sale. In certain preferred embodiments, the category of the inquiry can be indicated on a viewable area of the bottle.

While the specific embodiments have been illustrated and described, numerous modifications come to mind without significantly departing from the spirit of the invention, and the scope of protection is only limited by the scope of the accompanying claims.

What is claimed is:

1. A label assembly comprising:

a label affixed to a non-opaque bottle, said label having a first viewing area comprising an area free of opaque label material, and a second viewing area comprising an area free of opaque label material, a first indicia portion applied to an inward facing side of said label disposed substantially diametrically opposed from said first viewing area about said bottle and viewably aligned with said first viewing area, wherein said first indicia portion is not viewable from an outward facing side of said label in a first indicia area of said label on which it is applied, a second indicia portion applied to the inward facing side of said label disposed substantially diametrically opposed from said second viewing area about said bottle and viewably aligned with said second viewing area, wherein said second indicia portion is not viewable from the outward facing side of said label in a second indicia area of said label on which it is applied, and wherein said second indicia portion is separate and distinct from said first indicia portion, wherein said first indicia portion is viewable through said first viewing area when a level of substantially opaque fluid within said bottle is below said first indicia portion and said first viewing area, and wherein said second indicia portion is viewable through said second viewing area when a level of substantially opaque fluid within said bottle is below said second indicia portion and said second viewing area.

2. The label assembly according to claim 1, wherein said first viewing area is disposed vertically above said second viewing area, wherein said first indicia portion is disposed vertically above said second indicia portion, and wherein, neither of said indicia portions are viewable when the level of substantially opaque fluid within said bottle is above said first indicia portion under a first condition, said first indicia portion is viewable through said first viewing area and said second indicia portion is not viewable through said second viewing area when the level of substantially opaque fluid within said bottle is below said first indicia portion and said first viewing area but above said second indicia portion under a second condition, and both of said indicia portions are viewable when the level of substantially opaque fluid within said bottle is below said second indicia portion and said second viewing area under a third condition.

3. The label assembly according to claim 2, wherein said first viewing area and said second viewing area are disposed on the same side of said bottle, said first viewing area being aligned substantially directly above said second viewing area.

4. The label assembly according to claim 2, wherein said first viewing area and said second viewing area are disposed on substantially opposite sides of said bottle.

5. The label assembly according to claim 2, wherein said label comprises a single-piece wrap-around label.

6. The label assembly according to claim 2, wherein said label comprises a front label section disposed opposite and separated from a back label section.

7. The label assembly according to claim 6, wherein said first and second viewing areas are disposed on said front label section, and wherein said first and second indicia portions are disposed on said back label section.

8. The label assembly according to claim 6, wherein said first viewing area and said second indicia portion are disposed on said front label section, and said second viewing area and said first indicia portion are disposed on said back label section.

9. The label assembly according to claim 2, wherein the substantially opaque fluid within said bottle is a substantially opaque beverage for human consumption.

10. The label assembly according to claim 9, wherein said bottle is formed of non-opaque glass.

11. The label assembly according to claim 9, wherein said bottle is formed of non-opaque plastic.

12. The label assembly according to claim 2, wherein said first viewing area is substantially surrounded by opaque label material about its perimeter.

13. The label assembly according to claim 12, wherein said second viewing area is substantially surrounded by opaque label material about its perimeter.

14. The label assembly according to claim 13, wherein said first and second viewing areas are formed by holes in said label.

15. The label assembly according to claim 13, wherein said first and second viewing areas are formed of non-opaque label material.

16. The label assembly according to claim 2, wherein said first indicia portion contains subject matter which is logically related to first outward side indicia disposed near said first viewing area, and wherein said second indicia portion contains subject matter which is logically related to second outward side indicia disposed near said second viewing area.

17. The label assembly according to claim 2, wherein said second indicia portion contains subject matter which is logically related to subject matter contained in said first indicia portion.

18. The label assembly according to claim 17, wherein said first indicia portion contains an inquiry, and wherein said second indicia portion contains a response related to said inquiry.

19. The label assembly according to claim 17, wherein a relationship between the second indicia portion and the first indicia portion is clarified on the outward side of said label.

20. The label assembly according to claim 17, wherein said inquiry is a first image, and wherein said response is a second image related to said first image.

21. The label assembly according to claim 20, wherein said first image depicts an individual, and wherein said second image depicts the individual having a mode of attire or posing which is different than that of said first image.

22. The label assembly according to claim 18, wherein said inquiry is a question, and wherein said response is an answer related to said question.

23. The label assembly according to claim 18, wherein said inquiry is an answer, and wherein said response is a question related to said answer.

24. The label assembly according to claim 18, wherein said inquiry is the beginning of a statement, and wherein said response is a continuation of said statement.

25. A beverage bottle package containing a plurality of bottles each comprising the label assembly according to claim 18, wherein the subject matter contained in said inquiry of each assembly is classified in a distinct category, each of said plurality of bottles having inquiries classified in the same category.

26. The label assembly according to claim 1, wherein the substantially opaque fluid within said bottle is a substantially opaque beverage for human consumption.

27. The label assembly according to claim 1, wherein said first indicia portion contains subject matter which is logically related to first outward side indicia disposed near said first viewing area, and wherein said second indicia portion contains subject matter which is logically related to second outward side indicia disposed near said second viewing area.

28. The label assembly according to claim 1, wherein said second indicia portion contains subject matter which is logically related to subject matter contained in said first indicia portion.

29. The label assembly according to claim 28, wherein said first indicia portion contains an inquiry, and wherein said second indicia portion contains a response related to said inquiry.

30. The label assembly according to claim 28, wherein a relationship between the second indicia portion and the first indicia portion is clarified on the outward side of said label.

31. The label assembly according to claim 29, wherein said inquiry is a question, and wherein said response is an answer related to said question.

32. The label assembly according to claim 29, wherein said inquiry is an answer, and wherein said response is a question related to said answer.

33. The label assembly according to claim 29, wherein said inquiry is the beginning of a statement, and wherein said response is a continuation of said statement.

34. A beverage bottle package containing a plurality of bottles each comprising the label assembly according to claim 18, wherein the subject matter contained in said inquiry of each assembly is classified in a distinct category, each of said plurality of bottles having inquiries classified in different categories.

35. The beverage bottle package according to claim 34, wherein the category of each of said bottles is indicated in a viewable area on each of said bottles.

36. A label assembly comprising:

a label affixed to a non-opaque container, said label having a first viewing area comprising an area free of opaque label material, and a second viewing area comprising an area free of opaque label material, a first indicia portion applied to an inward facing side of said label disposed substantially diametrically opposed from said first viewing area about said container and viewably aligned with said first viewing area, wherein said first indicia portion is not viewable from an outward facing side of said label in a first indicia area of said label on which it is applied, a second indicia portion applied to the inward facing side of said label disposed substantially diametrically opposed from said second viewing area about said container and viewably aligned with said second viewing area, wherein said second indicia portion is not viewable from the outward facing side of said label in a second indicia area of said label on which it is applied, and wherein said second indicia portion is separate and distinct from said first indicia portion, wherein said first indicia portion is viewable through said first viewing area when a level of substantially opaque substance within said container is below said first indicia portion and said first viewing area, and wherein said second indicia portion is viewable through said second viewing area when a level of substantially opaque substance within said container is below said second indicia portion and said second viewing area.

37. The label assembly according to claim 36, wherein said first viewing area is disposed vertically above said second viewing area, wherein said first indicia portion is disposed vertically above said second indicia portion, and wherein, neither of said indicia portions are viewable when the level of substantially opaque substance within said container is above said first indicia portion under a first condition, said first indicia portion is viewable through said first viewing area and said second indicia portion is not viewable through said second viewing area when the level of substantially opaque substance within said container is below said first indicia portion and said first viewing area but above said second indicia portion under a second condition, and both of said indicia portions are viewable when the level of substantially opaque substance within said container is below said second indicia portion and said second viewing area under a third condition.

38. The label assembly according to claim 37, wherein said substance is a solid substance.

39. The label assembly according to claim 38, wherein said substance is consumable by humans.

40. The label assembly according to claim 37, wherein said substance is a liquid.

41. The label assembly according to claim 40, wherein said substance is consumable.

* * * * *